United States Patent [19]

Archambault

[11] 3,960,328

[45] June 1, 1976

[54] DISHWASHING MACHINE AND ROTARY SPRAYER THEREFOR

[76] Inventor: Jean Archambault, 500 Francois St., Apt. 207, Nuns' Island, Quebec, Canada

[22] Filed: Nov. 18, 1974

[21] Appl. No.: 525,029

[52] U.S. Cl. ..... 239/264; 239/568

[51] Int. Cl.[2] ..... B05B 3/00

[58] Field of Search ..... 239/568, 225, 251, 264

[56] References Cited

UNITED STATES PATENTS

| | | | |
|---|---|---|---|
| 1,966,572 | 7/1934 | Webb | 239/568 |
| 2,734,520 | 2/1956 | Abresch et al. | 239/225 |
| 2,904,265 | 9/1959 | Lyman | 239/568 |
| 3,051,183 | 8/1962 | Jacobs | 239/568 |
| 3,184,166 | 5/1965 | Wood | 239/264 |
| 3,342,421 | 9/1967 | Schutte | 239/251 |
| 3,361.367 | 1/1968 | Hein et al. | 239/568 |
| 3,753,352 | 8/1973 | McNally | 239/568 |
| 3,785,566 | 1/1974 | Jenkins | 239/264 |

*Primary Examiner*—Lloyd L. King

[57] ABSTRACT

A rotary sprayer of the type used in a dishwashing machine and having outlet apertures adapted to spray jets of cleaning liquid against the dishes. The present rotary sprayer includes outlet apertures formed by slots extending into bulges of one face thereof and is characterized by these slots and bulges being staggered and in disalignment to obtain more even pressures at the latter and by these slots extending parallel on each side of the rotation axis of the sprayer to prevent neutralizing interactions of the issuing sprays one on another.

7 Claims, 6 Drawing Figures

DISHWASHING MACHINE AND ROTARY SPRAYER THEREFOR

This invention relates to a dishwashing machine or the like and, more particularly, to a rotary sprayer of the type presently used in a dishwashing machine and including outlet apertures for outward spraying of a washing liquid.

So far, there have been provided different concepts of rotary sprayers of the above type for the purpose of controlling the spraying efficiency thereof and thereby optimize the cleaning of dishes. However, it has been noted that due to the adopted arrangement of the outlet orifices, these anterior rotary sprayers suffer at least one of the following disadvantages: uneven pressure, flows, and cleaning actions by the sprays of the different outlet apertures, neutralizing interaction between sprays of different outlet apertures, and unidirectional engagement of the sprays with any face of the dishes. For instance, it has been noted that outlet slots have been suggested which are so oriented one relative to another as to produce neutralizing interaction between the sprays issuing therefrom and/or these slots are aligned along a spraying bar, such that the pressure drops in the latter and in the sprays in relation to the distances of these slots relative to the axis of rotation thereof.

It is a general object of the present invention to provide a rotary sprayer of the above type and a dishwashing machine having a sprayer of the above type and wherein the outlet apertures are constructed and arranged to avoid all of the above disadvantages for improved cleaning action by the sprays issuing from these apertures.

It is a more specific object of the present invention to provide a rotary sprayer of the above type wherein the outlet apertures are in disalignment and staggered and are formed in outward bulges to obtain more even pressures at these apertures and more even cleaning action between the sprays.

It is another specific object of the present invention to provide a rotary sprayer of the above type, wherein the outlet apertures are constructed to produce fan-shape sprays particularly which are oriented relative to each other to prevent neutralizing interaction one on the other.

The above and other objects and advantages of the present invention will become better understood in the light of the following description of a preferred embodiment thereof, which is illustrated, by way of example only, in the accompanying drawings, wherein.

Figure 1:
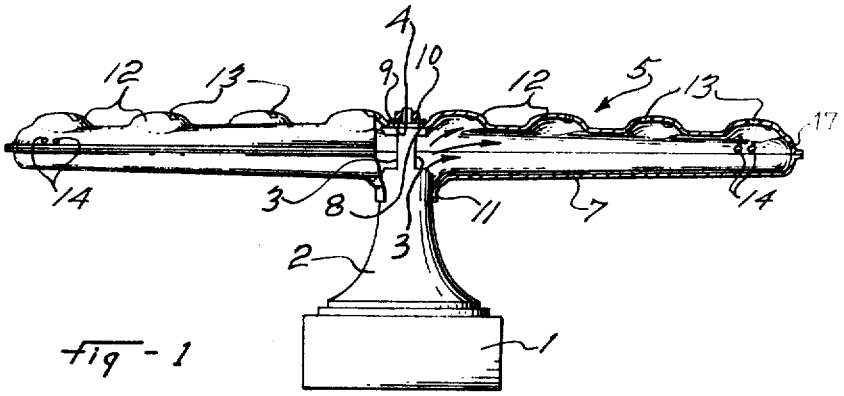
FIG. 1 is a side elevation view, partly in longitudinal section, of a rotary sprayer mechanism according to the present invention.
Figure 2:
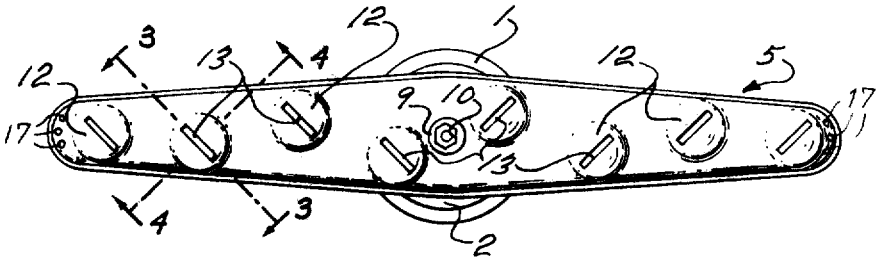
FIG. 2 is a top view of the rotary sprayer mechanism of FIG. 1.
Figure 3:
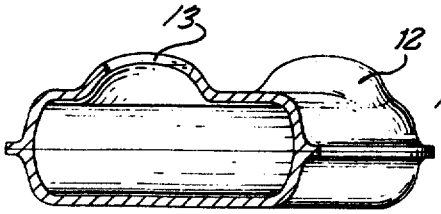
FIG. 3 illustrates a cross-sectional view as seen along line 3—3 in FIG. 1.
Figure 4:
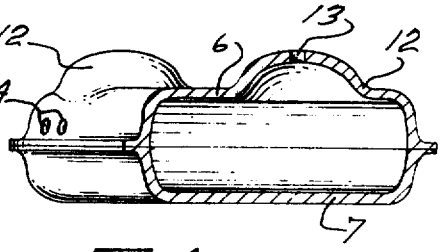
FIG. 4 is a cross-sectional view as seen along line 4—4 in FIG. 1.

The illustrated rotary sprayer includes a base 1, preferably containing any suitable pump, not shown, to force the cleaning liquid outwardly of the rotary sprayer and to cause its rotation. A hub 2 is provided, being of circular cross-section and hollow for the upward flow of the cleaning liquid therein. The hub 2 is of diminishing cross-section toward the outer end or head thereof, which is provided with a pair of diametrically opposite outlet apertures 3 therein and forms an axial shoulder 4.

A hollow bar 5 is supported on the hub 2 for rotation thereon. The hollow bar 5 has a pair of axially opposite walls 6 and 7 constituting the top and bottom faces respectively thereof. The bar 5 is rotatably mounted about an axis extending transversely therethrough at the longitudinal center thereof. The top wall 6 and the bottom wall 7 of the hollow bar 5 are provided with each a central aperture, or opening, arranged coaxially of the afore-mentioned rotation axis. The opening in the top wall is defined by a circular edge or rim 8 adapted to rest on the shoulder 4 and to be freely retained against the latter by a washer 9 and a nut 10, or by any suitable expedient. The opening in the bottom wall 7 is formed by an annular flange 11 adapted to fit around the hub 2 in axially spaced-apart relationship along the latter and on axially opposite side of the outlet openings 3 relative to the edge 8.

The top axial face 6 is formed with bulges 12 having an upwardly rounded outline and projecting outwardly of the remainder of the wall 6. These bulges 12 are staggered one from the next along the length of the bar. The latter defines a longitudinal axis and the bulges 12 are in disalignment one from another in the direction of this axis. Furthermore, the bulges are positioned at progressively diminishing spacings from the same longitudinal axis in outward sequence along the latter. Therefore, a more even pressure is obtained at the different bulges.

A slot 13 is formed into each bulge 12 and has a longitudinally convex outline due to the rounded shape of the bulge 12. This advantageously produces a spray or jet which issues from the outlet slot in a flat fan shape. The bulges 12 additionally assist in regulating the pressure of the sprays due to the regulatory function of the reserve of cleaning liquid held therein. The slots 12 on anyone side of the rotation axis are all substantially parallel, thus preventing neutralizing interactions between jets issuing therefrom. The slots 12 on one side of the rotation axis are transversely oriented relative to the slots on the other side of the same axis, thus producing bidirectional actions of the jets on the overlying dishes, not shown, conventionally placed edgewise in a rack of the dishwashing machine.

Ports 14 are provided through the lateral wall of the hollow bar 5, at opposite ends thereof and on the opposite sides respectively relative to the vertical median plane of the bar, such that the jets issuing therefrom will produce rotation of the rotary sprayer.

It must be noted that the outlet openings 3 are aligned with the longitudinal axis of the bar 5.

Figure 5:
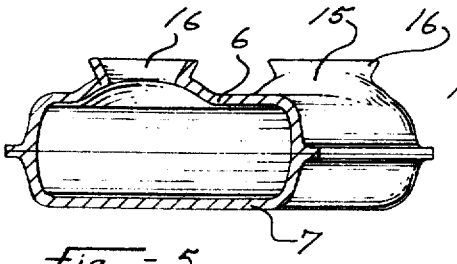
FIG. 5 and FIG. 6 are cross-sectional views as in FIGS. 3 and 4 and illustrating a different embodiment according to the present invention.
Figure 6:
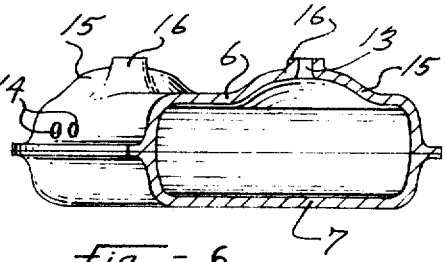

FIGS. 5 and 6 illustrate a slightly different construction of bulges 15 which have the same rounded outline, the same slots 13 and are similarly positioned, but which are distinguished by having each a fan-shape flat outlet 16 projecting outwardly thereof in registry with the corresponding convex shape slot 13. These fan-shape outlets 16 serve to better form fan-shaped sprays.

The ends of hollow bar 5 are preferably provided with small openings or ports 17 which are upwardly outwardly inclined, such that the water jets issuing therefrom will provide additional washing liquid, especially in the corners of the square-shaped tube of the washing machine. It has been found that the rotary sprayer of the invention can be used in a washing machine cabinet of standard size, as found in home dishwashing machines, but in association with a water pump of much greater capacity, resulting in a much higher flow rate through the sprayer with a consequently considerably reduced washing time, as compared to conventional home dishwashing machines. Yet the fan-shaped sprays issuing from the slots of the rotary sprayer have a low enough water velocity, so as not to dislodge and break the dishwares stored in the machine.

The above is obtained due to the arrangement of the slotted bulges on the arms of the rotary sprayer, such that there is disalignment of the bulges in the direction of the longitudinal axis of the sprayer and that the bulges are staggered one from the next along said longitudinal axis with the slots extending diagonally and substantially parallel to one another on each side of the rotation axis.

I claim:

1. A rotary sprayer, for use in a dishwashing machine and the like, comprising a hollow bar rotatable about a rotation axis extending through the longitudinal center thereof, defining a pair of axial walls relative to said rotation axis, said bar having a longitudinal axis extending transversely of said rotation axis, outwardly projecting bulges formed by one of said axial walls, staggered one from the next and in disalignment one from another in the direction of said longitudinal axis, each bulge having a slot at the outer portion thereof, the slots extending substantially parallel one to another on each side of said rotation axis.

2. A rotary sprayer as defined in claim 1, wherein said bulges are positioned at progressively diminishing spacings from said longitudinal axis in outward sequence along the latter.

3. A rotary sprayer as defined in claim 2, wherein said bulges have a rounded outline forming longitudinally convex shape slots whereby to produce fan-shaped sprays and the slots on one side of said rotation axis are transversely directed relative to the slots on the other side of said rotation axis.

4. A rotary sprayer as defined in claim 3, wherein said bulges form each a fan-shaped flat outlet projecting outwwardly of said rounded outline in registry with the corresponding convex shape slot.

5. A rotary sprayer as defined in claim 4, wherein the ends of said bar are provided with upwardly and outwardly inclined small openings.

6. A rotary sprayer as defined in claim 1, wherein each of said axial faces has an opening therethrough coaxial with said rotation axis, a hub member projects through said openings and has diametrically opposite outlets communicating with the interior of said hollow bar, and said faces define a rim portion around said coaxial openings respectively snugly fitting against said hub member in spaced-apart relationship along the latter on axially opposite sides of said outlets respectively.

7. A rotary sprayer as defined in claim 6, wherein said hub member includes an axial shoulder portion, said rim portion of said one face snugly rests onto said axial portion and said rim portion of the other of said axial faces forms an inner flange peripherally resting on said hub member.

* * * * *